US010019880B1

(12) United States Patent
Winters

(10) Patent No.: US 10,019,880 B1
(45) Date of Patent: Jul. 10, 2018

(54) PORTABLE SECURITY SYSTEM

(71) Applicant: Brad Winters, Waukon, IA (US)

(72) Inventor: Brad Winters, Waukon, IA (US)

( * ) Notice: Subject to any disclaimer, the term of this patent is extended or adjusted under 35 U.S.C. 154(b) by 0 days.

(21) Appl. No.: 15/819,036

(22) Filed: Nov. 21, 2017

Related U.S. Application Data

(60) Provisional application No. 62/425,302, filed on Nov. 22, 2016.

(51) Int. Cl.

| | |
|---|---|
| ***G08B 19/00*** | (2006.01) |
| ***G08B 13/196*** | (2006.01) |
| ***G08B 5/38*** | (2006.01) |
| ***G08B 25/00*** | (2006.01) |

(52) U.S. Cl.
CPC ..... *G08B 19/00* (2013.01); *G08B 5/38* (2013.01); *G08B 13/19656* (2013.01); *G08B 25/006* (2013.01)

(58) Field of Classification Search
CPC .. G08B 19/00; G08B 25/006; G08B 13/1956; G08B 5/386
USPC ..... 340/521, 500, 628
See application file for complete search history.

(56) References Cited

U.S. PATENT DOCUMENTS 2,851,680 A * 9/1958 La Cavera ..... G08B 15/00 116/23
3,925,763 A * 12/1975 Wadhwani ..... G08B 25/06 340/310.11
4,092,643 A * 5/1978 Stolarczyk ..... G08B 19/005 340/521
4,319,228 A * 3/1982 Daniels ..... G08B 13/00 340/521
4,742,336 A * 5/1988 Hall ..... G08B 25/10 340/531
5,200,735 A * 4/1993 Hines ..... G08B 25/10 340/539.11
6,181,244 B1 * 1/2001 Hall ..... G08B 25/10 340/539.1
6,380,860 B1 * 4/2002 Goetz ..... G08B 17/00 340/539.1
7,961,088 B2 * 6/2011 Watts ..... B60R 25/1003 340/506
8,451,132 B1 5/2013 Van Vleet
2016/0351043 A1 12/2016 Tabe
2017/0124830 A1 5/2017 Fadell et al.

* cited by examiner

*Primary Examiner* — Eric M Blount
(74) *Attorney, Agent, or Firm* — Goldstein Law Offices, P.C.

(57) ABSTRACT

A portable security system comprising a control unit and one or more modular sensors adapted to detect the presence of various alarm conditions within a monitoring location. The control unit is operably connected to the modular sensors via sensor cables, and further comprises a portable housing allowing a user to easily transport and deploy the portable security system within a monitoring location. The control unit further contains an auto-dialer, which transmits an alarm call to an alarm recipient once the system detects the alarm condition. The housing may further have a storage compartment covered by a hingedly attached housing lid which stores the modular sensors when the system is not in use, allowing the user to transport the system in a unitary package.

16 Claims, 7 Drawing Sheets

PORTABLE SECURITY SYSTEM

CROSS-REFERENCE TO RELATED APPLICATIONS

This application is a nonprovisional utility application of provisional patent application, Ser. No. 62/425,302 filed in the United States Patent Office on Nov. 22, 2016, claims priority therefrom, and is expressly incorporated herein by reference in its entirety.

TECHNICAL FIELD

The present disclosure relates generally to a security system. More particularly, the present disclosure relates to a portable security system equipped with a variety of modular sensors which is also self-contained and portable, allowing a user to easily transport and deploy the system within a monitoring location.

BACKGROUND

Conventional security systems are commonly used in homes and businesses to detect intrusions, fires, emergencies, and other extraordinary events. Such security systems are typically permanently installed within the home or business by professionals, and are potentially costly to purchase and operate through alarm monitoring services, particularly when users wish to install a system which provides the full range of sensors and services. Therefore, conventional security systems may prove impractical when users wish to protect their homes on a temporary basis, such as during a vacation, and may prove impossible to remove and transfer should users move to a new house or building. Furthermore, conventional security systems generally cannot be installed in vehicles, such as campers and RVs, or in structures and locations which lack power and communication connections, such as construction sites, cabins, or lake houses.

While examples of security systems which are portable can be found within the prior art, these systems are typically highly specialized or costly, and are often easily damaged. Existing portable systems also require users to transport the components of the system in separate packages containing the various sensors and control mechanisms, reducing the portability of the system and potentially increasing the difficulty of setting up and using such systems.

Therefore, there is a need for a portable security system which is durable, self-contained, and easily transported and deployed, while offering a full range of detection and alert capabilities.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a portable security system which is self-contained, portable, and able to detect a wide range of alert conditions within a monitoring location. Accordingly, the present disclosure provides a portable security system comprising one or more modular sensors adapted to detect an alert condition, and a control unit which is operably connected to each modular sensor through one or more sensor connection ports. The control unit comprises a portable housing which can be carried by a user and deployed at the monitoring location. The one or more modular sensors may comprise a smoke detector adapted to detect a fire alert condition, a thermostat adapted to detect a freezing temperature alert condition, a motion sensor adapted to detect a motion alert condition, or a flow sensor adapted to detect a water flow alert condition.

It is another aspect of an example embodiment in the present disclosure to provide a portable security system where the modular sensors may be quickly connected and positioned anywhere within the monitoring location. Accordingly, each modular sensor comprises a sensing unit attached to a sensor cable, and each sensor cable is detachably connected to the one or more sensor connection ports via a sensor plug. Each sensor cable can be provided in increments of five, ten, twenty feet, or more, allowing the user to position each modular sensor at any point within the monitoring location.

It is yet another aspect of an example embodiment in the present disclosure to provide a portable security system which alerts the user or emergency services when the system detects an alert condition. Accordingly, the control unit contains a control circuit comprising one or more alert switches, an alert timer circuit, and an auto-dialer. The alert switches and alert timer circuit become active when the alert condition is detected, causing the auto-dialer to transmit an alarm call to an alarm recipient. The alarm recipient may be the user, as well as the police and fire departments, and the auto-dialer may be configured to transmit the alarm call to specific alarm recipients depending on the type of alert condition detected.

It is a further aspect of an example embodiment in the present disclosure to provide a portable security system which allows the entire portable security system to be stored and transported in a unitary package. Accordingly, the housing of the control unit may comprise a housing lid which opens and closes between an open and a closed position. The housing lid may further contain a lid compartment containing one or more cable storage mounts. Each cable storage mount is adapted to store one of the modular sensors by coiling the sensor cable around the storage mount when the modular sensor is not in use. This allows the user to quickly and easily transport, deploy or disassemble the portable security system by removing or replacing the modular sensors from the lid compartment as needed.

It is yet another aspect of an example embodiment in the present disclosure to provide a portable security system which can operate with the housing lid in a closed or open position. Accordingly, the housing may have a housing top, front rear bottom, and side panels, and the one or more sensor connection ports may be positioned on the housing front or side panels, as well as on the top panel. The housing lid covers the housing top panel when placed in the closed position, therefore positioning the sensor connection ports on the top panel allows the housing lid to protect the sensor connection ports when the system is not in use, while positioning the sensor connection ports on the housing front or side panels allows the system to be deployed with the housing lid in the closed position.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1A:
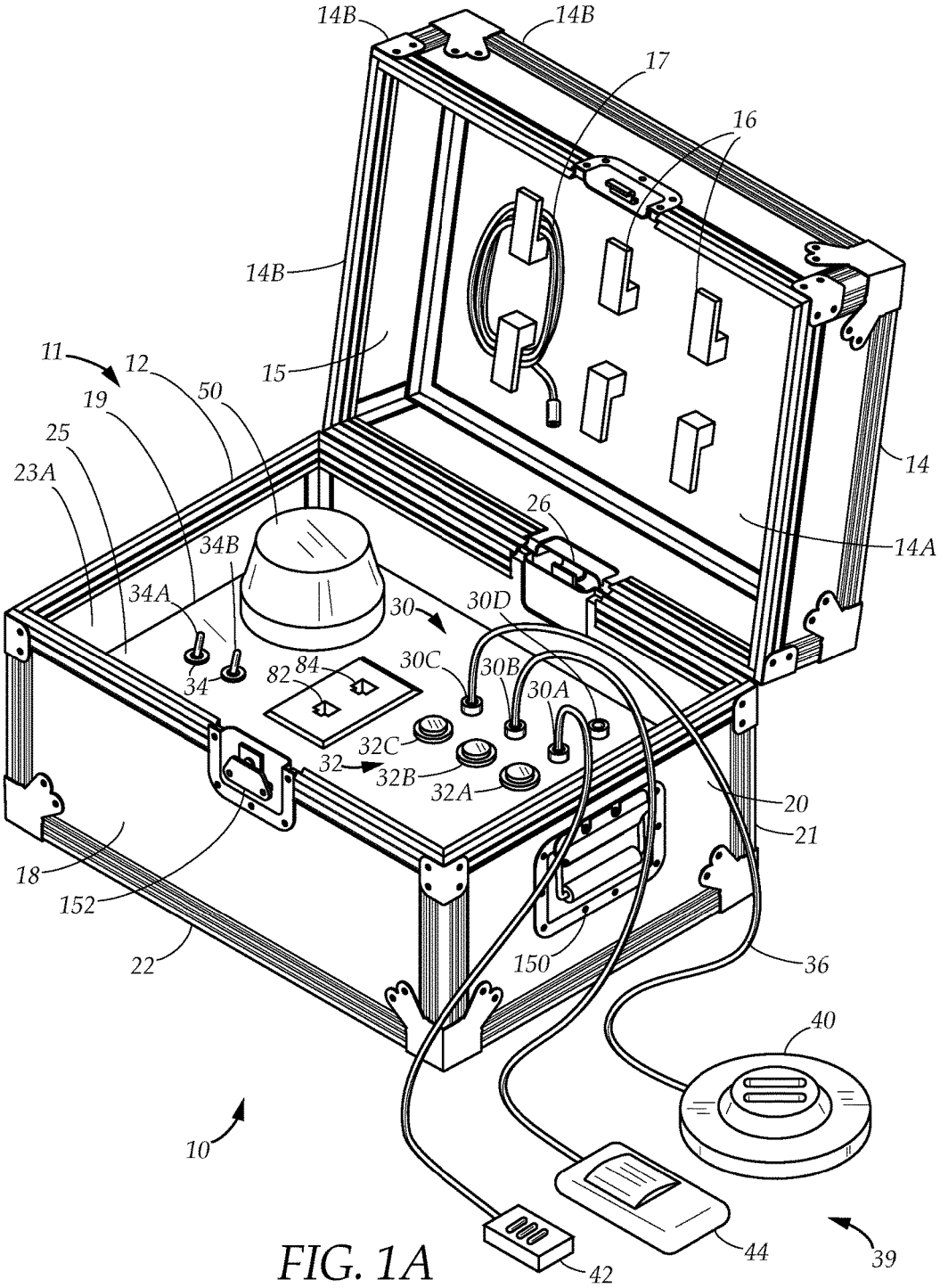
FIG. 1A is diagrammatical perspective view of an embodiment of a portable security system with attached sensor modules, in accordance with the present disclosure.

FIG. 1A illustrates an embodiment of a portable security system 10 which is self-contained and capable of being quickly and easily deployed by a user to a monitoring location to detect the presence of an alert condition such as such as fire, freezing temperature, motion, and water flow. Upon detecting the alert condition, the portable security system 10 then transmits an alarm call to at least one alarm recipient. The monitoring location can be a building such as a house or cabin, a vehicle, construction site, or other structure, and may further be an open area.

The portable security system 10 comprises a control unit 11 and at least one modular sensor 39. Each modular sensor 39 comprises a sensing unit operably attached to a sensor cable 36, and each sensor cable 36 has sensor plug. The control unit 11 has one or more sensor connection ports 30 adapted to receive the sensor plug of the modular sensors 39, forming an operable connection between the modular sensor 39 and the control unit 11. The sensor cables 36 can be any length, allowing each modular sensor 39 to be placed anywhere within the monitoring location. For example, the sensor cables 36 may be provided in increments of five, ten, twenty feet, or longer, along with one or more extension cables adapted to link the sensor cables 36 to the sensor connection ports 30 of the control unit 11, in order to extend the reach of the modular sensors 39.

The control unit 11 further comprises a portable housing 12, and may be equipped with a power cable and power supply for drawing electrical current from a power source, as well as a rechargeable battery for providing backup power to the control unit 11. Each modular sensor 39 may be adapted to detect the presence of different alert conditions, and transmit an alert signal to the control unit 11 upon detection of the alert condition. For example, the portable security system 10 may employ a smoke detector 40 for detecting fire, a thermostat 42 for detecting freezing temperature, and a motion sensor 44 for detecting motion. Water flow may be detected by positioning a water flow sensor in a water pipe or a float sensor in a water storage tank, where unwanted water flow through the water pipe or a change in water level within the storage tank may indicate a ruptured water pipe. Other types of modular sensors commonly employed with security systems may also be used with the portable security system. The control unit 11 monitors each of the connected modular sensors 39, and may transmit the alarm call to the alarm recipient upon receiving an alert signal from any of the modular sensors 39. The alarm recipient can be an emergency service such as the police or fire department, the user, or any person reachable by a phone number. Furthermore, the user may configure the auto-dialer to contact a specific list of alarm recipients. The alarm call can be an automated voice call, text message, or other electronic notification, and may be transmitted by the control unit 11 via phone line, mobile phone or data network, or the Internet, via an auto-dialer contained within the control unit. In some embodiments, the alarm call may further indicate the type of alert condition detected by the portable security system, and the auto-dialer may be configured to contact the appropriate emergency service to respond to the alert condition. For example, in the event of a fire, the auto-dialer may transmit the alarm call to the fire department. The alarm call may further indicate the address of the monitoring location. The control unit 11 may also incorporate a strobe light 50 to provide a visual alarm warning, or a horn to provide an audible alarm warning, upon receiving an alarm signal from the modular sensors 39. The strobe light 50 may be attached to the control unit 11, or may alternatively be connected to the control unit 11 with a strobe cable, allowing the strobe light 50 to be positioned throughout the monitoring location. The sensor connection ports 30 may be adapted to receive the strobe cable.

The housing 12 may be formed as a rectangular box having a housing front panel 18, a housing top panel 19, a pair of housing side panels 20, a housing rear panel 21, and a housing bottom panel 22. The housing 12 may further have a handle 150 on any of the housing front, side, or rear panels 18, 20, 21, allowing the user to carry and transport the portable security system 10 by grasping the handle 150. The housing 12 is portable but durable, and is therefore preferably made from a combination of lightweight but strong materials, such as plastic, aluminum, stainless steel, and other materials as would be apparent to a person of ordinary skill in the art in the field of the invention. The sensor connection ports 30 may be configured on a security system panel 25 positioned on the housing top panel 19, or alternatively on any of the housing front, side, or rear panels 18, 20, 21. The security system panel 25 may have one or more control switches 34, and may also include one or more alert indicator lights 32 which illuminate when the control unit 11 receives an alert signal from one of the modular sensors 39. The security system panel 25 may further have a network interface port 82, such as an Ethernet port, for connecting the control unit 11 to a WAN, such as the Internet, as well as one or more communication ports such as a phone jack. The security system panel 25 may also have an IP camera port 84 which allows the control unit 11 to connect to an IP camera. The IP camera captures and transmits video to a remote IP camera server via an IP camera feed, providing the user with a video feed of a portion of the monitored location within the view of the IP camera. The IP camera may also be configured to automatically activate once the portable security system 10 detects an alert condition. The IP camera port 84 may be configured as an Ethernet port with Power over Ethernet capability, allowing the IP camera to transmit the video feed to the remote IP camera server via the WAN as well as providing power to the IP camera via a single connection. The housing 12 further has a housing compartment, corresponding to the interior space within the housing defined by the housing front, top, side, rear, and bottom panels 18, 19, 20, 21, 22. The housing compartment contains the power supply, battery, and a control circuit which governs the functions of the control unit 11. Note that this example is non-limiting, and the housing 12 may be formed in other shapes and configurations.

In a preferred embodiment, the housing 12 may further have a housing lid 14 which can be hingedly attached to the housing rear panel 21 via one or more hinges 26. The housing top panel 19 may be disposed in a recessed position towards the housing bottom panel 22, such that the housing front, side, and rear panels 18, 20, 21 extend upwards past the housing top panel 19 to form an upper compartment 23A. The housing lid 14 covers the upper compartment 23A when placed in a closed position, and may be opened along the hinges 26 to expose the upper compartment 23A when placed in an open position. The housing lid 14 is configured to match the perimeter shape of the housing 12 such that the housing lid 14 aligns with the housing front, side, and rear panels 18, 20, 21 to completely cover the upper compartment 23A when placed in the closed position. The housing lid 14 therefore covers and protects the security system panel 25 when the control unit 11 is being transported or is otherwise not in use. The housing lid 14 may further be releasably secured to the housing 12 by one or more latches 152.

The housing lid 14 has a lid inner surface 14A which faces towards the upper compartment 23A when the housing lid 14 is in the closed position. The lid inner surface 14A may have one or more cable storage mounts 16 for storing modular sensors 39, sensor cables, extension cables, and other accessories. The cable storage mounts 16 may comprise hooks, brackets, spools, reels, ties, or other fixtures around which the modular sensors 39 or sensor cables can be wrapped and retained for storage. In one embodiment, the cable storage mounts 16 are implemented as pairs of hooks, and an unused modular sensor is stored by wrapping the sensor cable of the modular sensor around the hooks to form a coil 17. The housing lid 14 may further have a plurality of lid panels 14B which extend downwards from the lid inner surface 14A to form a lid compartment 15 defined by the lid inner surface 14A and the lid panels 14B. In a preferred embodiment, there are four lid panels 14B which align with the housing front, side, and rear panels 18, 20, 21. The lid compartment 15, along with the upper compartment 23A, provides space for retaining and storing modular sensors and sensor cables. In addition, the cable storage mounts 16 may also be used to retain the power cable, as well as other cables and accessories such as an Ethernet cable.

The housing lid 14, with its cable storage mounts 16, therefore greatly enhances the portability of the portable security system 10 by allowing the housing 12 to store every component of the portable security system 10 until the component is ready to be used. In order to deploy the portable security system 10 within the monitoring location, the user simply places the control unit 11 within the monitoring location, opens the housing lid 14, and removes the desired modular sensors 39 and cables from the cable storage mounts 16. The user may then connect the control unit 11 to the power source, plug in each modular sensor 39 to one of the sensor connection ports 30, and place each modular sensor 39 at a suitable position within the monitoring location, at which point the deployment of the portable security system 10 is complete. To disassemble the portable security system 10, the user simply detaches the control unit 11 from the power source, unplugs each modular sensor 39 from the control unit 11, stores the modular sensors 39 and cables using the cable storage mounts 16, and closes the housing lid 14. The user may then pick up the portable security system 10, now entirely enclosed within the housing 12, and carry it out of the monitoring location.

Figure 1B:
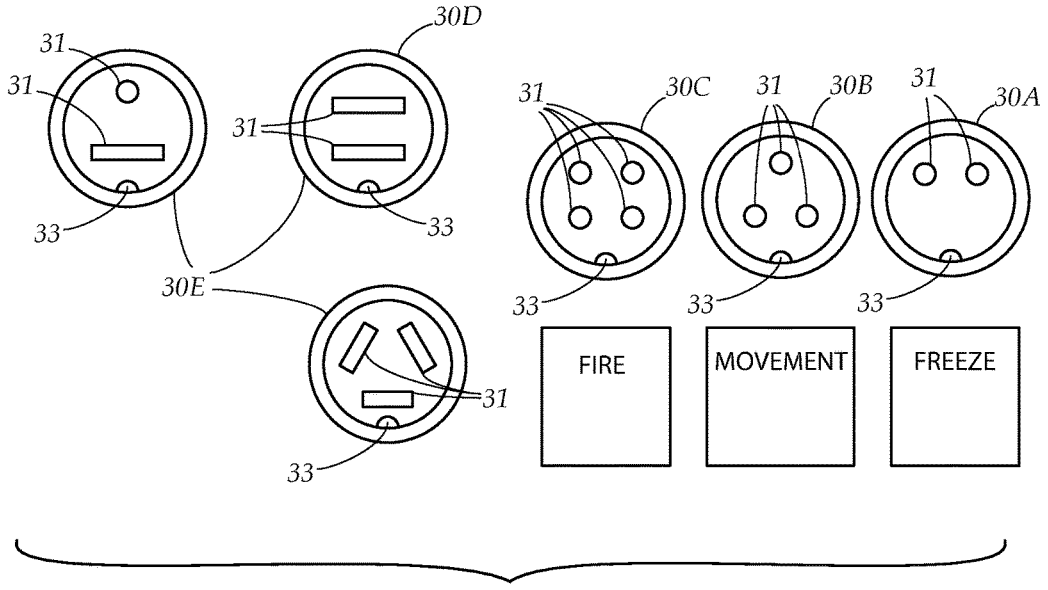
FIG. 1B is a diagrammatical front view of a set of exemplary sensor connection ports, with each sensor connection port having a unique pin configuration, in accordance with the present disclosure.
Figure 1C:
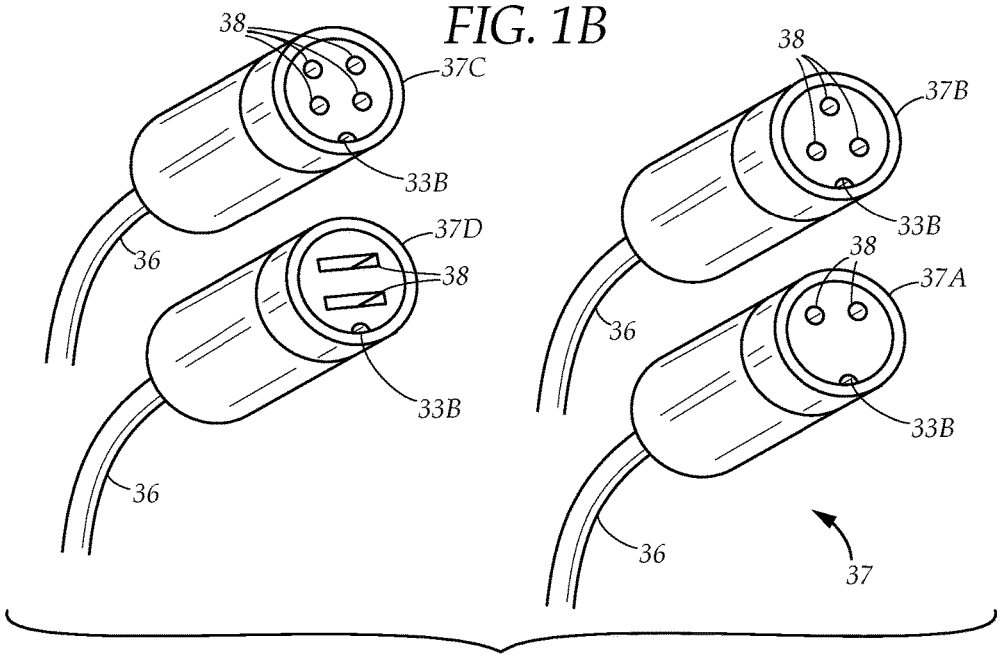
FIG. 1C is a diagrammatical perspective view of a set of exemplary sensor plugs, with each sensor plug having a unique pin receptacle configuration adapted to interface with the pin configurations of the sensor connection ports.

Turning now to FIGS. 1B-1C, while simultaneously referring to FIG. 1A, the sensor connection ports 30 and the sensor plugs 37 are configured to simplify and speed up the deployment of the portable security system 10 by ensuring an error-free connection between each modular sensor 39 and the appropriate sensor connection port 30. Furthermore, to speed up the disassembly of the portable security system, the sensor plugs 37 may be quickly detached from the sensor connection ports 30. In a preferred embodiment, each sensor connection port 30 may be configured as a substantially circular receptacle, configured with one or more pins 31. Each sensor connection port 30 may also have an alignment tab 33 disposed along the edge of the sensor connection port 30. The one or more pins 31 of each sensor connection port 30 may be arranged in a particular pin configuration. For example, control unit 11 may have a first, second, and third sensor connection port 30A, 30B, 30C. The pin configuration of the first sensor connection port 30A may be two pins 31 arranged side by side, the pin configuration of the second sensor connection port 30B may be three pins arranged in a triangular pattern, while the pin configuration of the third sensor connection port 30C may be four pins 31 arranged in two rows of two pins. Each sensor plug 37 is configured to interface with the sensor connection ports 30, and may therefore be configured in a cylindrical shape to allow the circular sensor connection ports 30 to receive the sensor plugs 37. Each sensor plug 37 further has one or more pin receptacles 38 adapted to receive the one or more pins 31 of the sensor connection ports 30. Each sensor plug 37 may further have an alignment groove 33B adapted to receive the alignment tab 33 of the sensor connection ports 30. The one or more pin receptacles 38 of each sensor plug 37 may be arranged in a particular pin receptacle configuration to allow the one or more pin receptacles 38 to align with and receive the one or more pins 31 of the sensor connection ports 30. For example, the portable security system 10 may have a first sensor plug 37A, a second sensor plug 37B, and a third sensor plug 37C. The pin receptacle configuration of the first sensor plug 37A may be two pin receptacles 38 arranged side by side, matching the pin configuration of the first sensor connection port 30A and allowing the first sensor plug 37A to interface with the first sensor connection port 30A. The pin receptacle configuration of the second sensor plug 37B may be three pin receptacles 38 arranged in a triangular pattern, while the pin configuration of the third sensor plug 37C may be four pin receptacles 38 arranged in two rows of two pin receptacles 38, allowing the second sensor plug 37B and the third sensor plug 37C to interface with the second and third sensor connection ports 30B, 30C respectively. The first sensor connection port 30A may be configured to connect to the thermostat 42, while the second and third connection ports 30B, 30C may be configured to connect to the motion sensor 44 and the smoke detector 40 respectively. The thermostat 42, motion sensor 44, and the smoke detector 40 may accordingly be configured with sensor cables 36 equipped with the first, second, and third sensor plugs 37A, 37B, 37C respectively. The alignment tab 33 of each sensor connection port 30 and the alignment groove 33B of each sensor plug 37 further serve to ensure that each sensor plug 37 is always oriented correctly in relation to the sensor connection port 30. This combination of unique pin configurations and pin receptacle configurations allows the user to quickly match the sensor plug 37 of each modular sensor 39 with the appropriate sensor connection port 30, and prevents the user from erroneously inserting one of the sensor plugs into the incorrect sensor connection port 30.

Additional sensor connection ports 30 may be represented by further pin configurations. The control unit 11 may have a fourth sensor connection port 30D, with pins 31 arranged in one or more alternate pin configurations 30E. In the alternate configurations 30E, the one or more pins may also be configured as flat prongs, as well as in any other shapes commonly employed in electrical connectors as will be apparent to a person of ordinary skill in the art in the field of the invention. The portable security system 10 may have modular sensors 39 configured with a fourth sensor plug 37D, and the pin receptacle configuration of the fourth sensor plug 37D may match the pin configuration of the fourth sensor connection port 30D. Note that these examples are non-limiting, and the pin receptacle configurations of the first, second, and third sensor connection ports 30A, 30B, 30C, as well as the pin receptacle configurations of the first, second, and third sensor plugs 37A, 37B, 37C, may employ pins 31 and pin receptacles 38 in any shape and configuration, including configurations where the one or more pins 31 are configured on the sensor plugs 37 instead of the sensor connection ports 30, and the one or more pin receptacles 38 are configured on the sensor connection ports 30. Furthermore, the sensor connection ports 30 and the corresponding sensor plugs 37 may be configured in a rectangular, hexagonal, or any other shape. In some embodiments, one of the sensor connection ports 30 may be adapted to connect to the strobe light via the strobe cable, and the strobe cable may have a strobe cable plug with a unique pin or pin receptacle configuration to facilitate a quick and error-free connection.

Figure 1D:
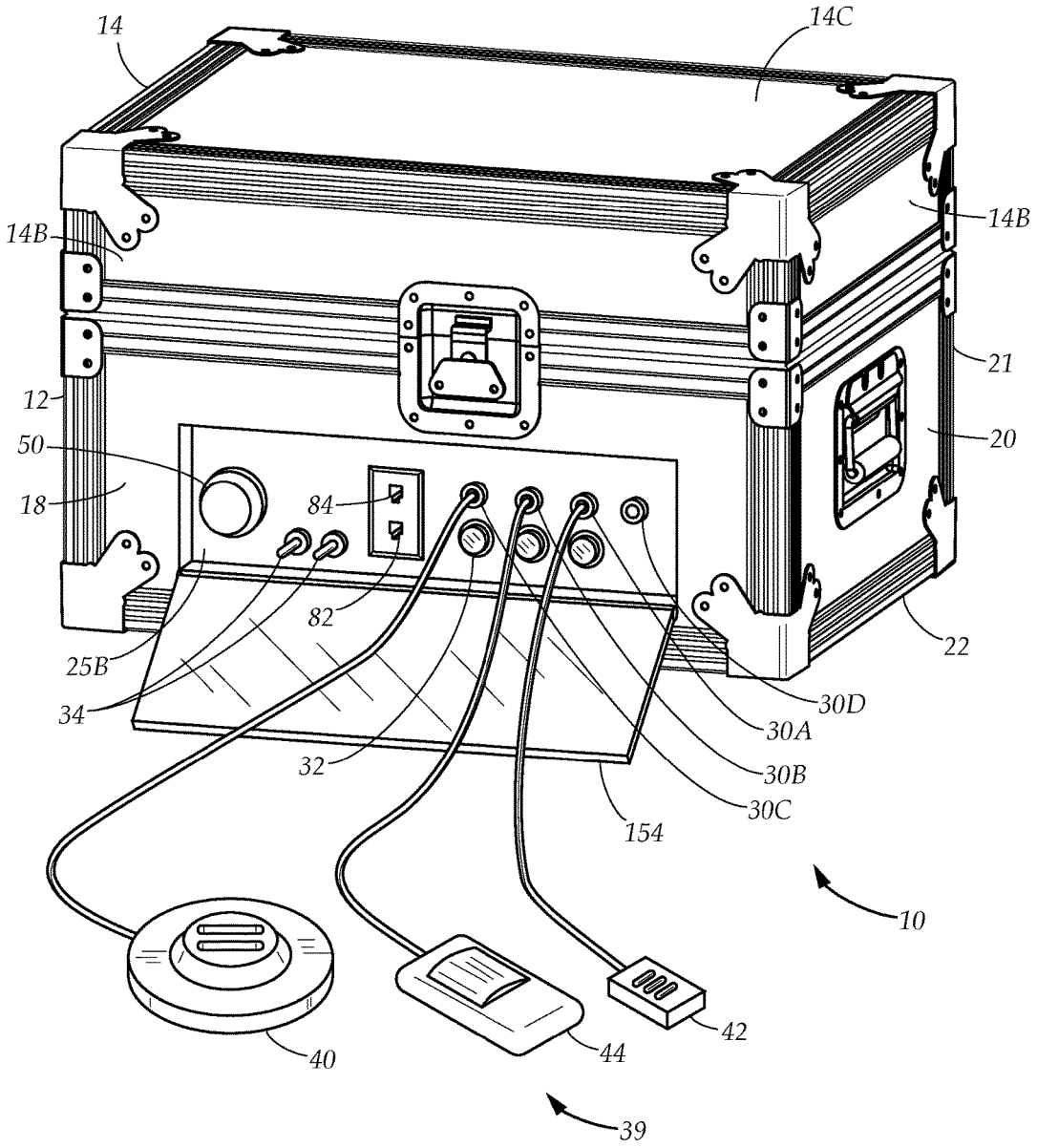
FIG. 1D is a diagrammatic perspective view of an embodiment of the portable security system where the security system panel is positioned on the housing front panel.

Turning now to FIG. 1D, while continuing to refer to FIG. 1A, in an alternate embodiment, the control unit 11 may have an external security system panel 25B disposed on the housing front, side, or rear panels 18, 20, 21. This allows the portable security system 10 to be deployed and used with the housing lid 14 placed in the closed position. The external security system panel 25B may be equipped with a cover 154, which covers and protects the external security system panel 25B. The cover 154 may be removable, or hingedly connected to the housing 12. In an alternate embodiment, the control unit may be equipped with both the security system panel 25 disposed on the housing top panel 19, as well as the external security system panel 25B. The sensor connection ports 30 and alert indicator lights 32, as well as the network interface port 82 and IP camera port 84, may be positioned on the external security system panel 25B, while the control switches 34 may be positioned on the security system panel 25. This allows the control switches 34 to remain protected under the housing lid 14, while allowing the sensor connection ports 30 and alert indicator lights 32 to remain accessible to the user when the housing lid 14 is in the closed position. The housing 12 may further be adapted to be weatherproof, allowing the portable security system to be deployed in an outdoor monitoring location. In certain embodiments, the housing 12 may be configured without the housing lid 14. In order to protect the security system panel 25 in the absence of the housing lid 14, the security system panel 25 may also be configured with the cover 154.

Figure 2:
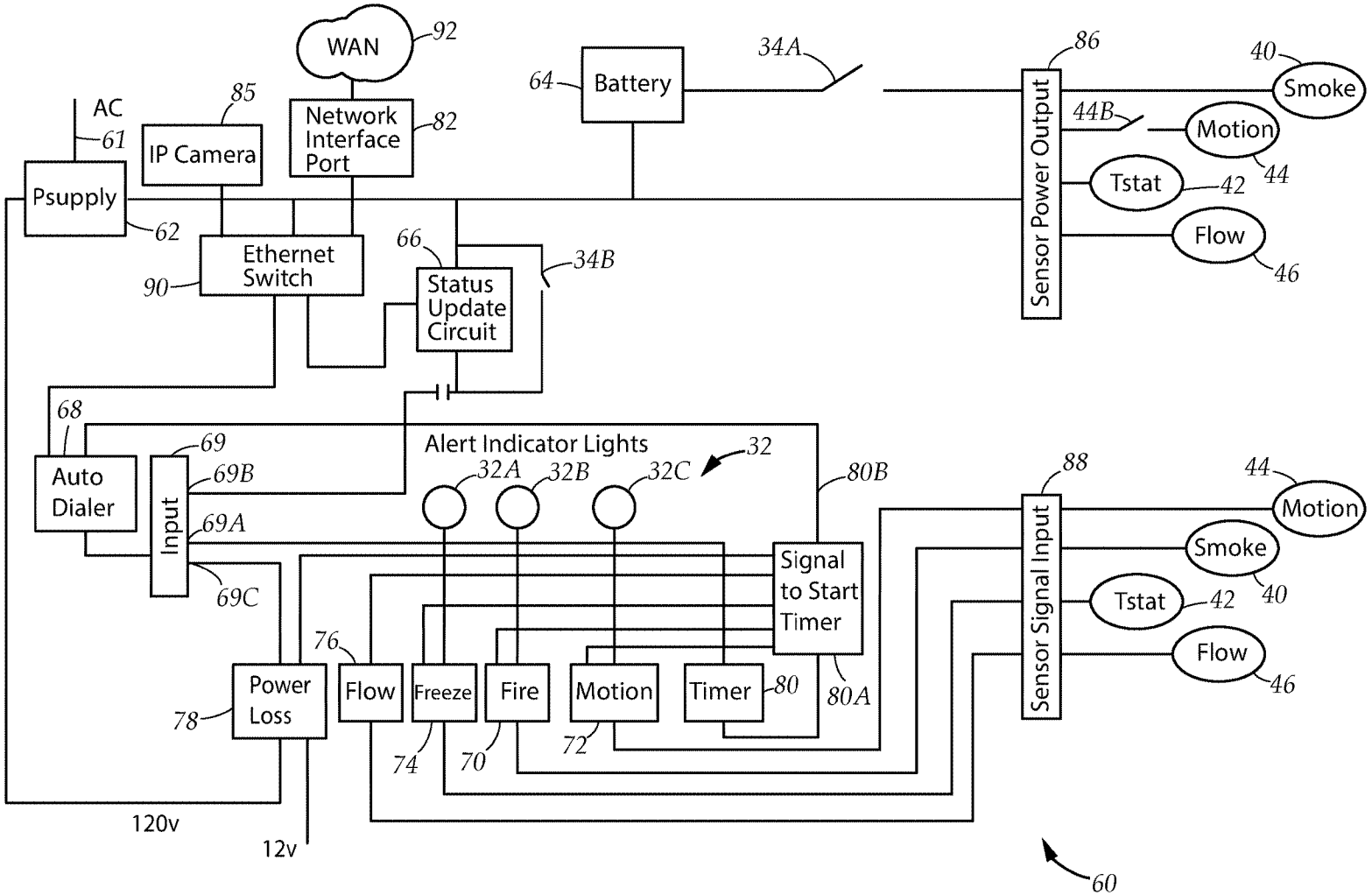
FIG. 2 is a schematic diagram depicting an exemplary portable security system control circuit, in accordance with the present disclosure.

Referring now to FIG. 2 while simultaneously referencing FIGS. 1A-D, the control circuit 60 governs the functions of the portable security system 10, and is enclosed within the housing compartment. The control circuit 60 operably connects the components of the control unit 11 in order to implement the detection of alert conditions and the transmission of alarm calls, and further distributes electrical current from the power supply 62 throughout the control unit 11. The power supply 62 draws electrical current from the power source 61 which may, for example, be a standard 120V/220V AC power outlet. The power supply 62 may then provide the control unit 11 with electrical power at 12V DC or other operating voltage, as will be apparent to a person of ordinary skill in the art in the field of the invention. The control circuit 60 may further distribute power throughout the control unit 11 from the battery 64, thus allowing the portable security system 10 to function in the event that electric current from the power source 61 is interrupted. The battery 64 may be recharged by drawing power from the power supply 62. The battery 64 may further be prevented from providing backup power to the control circuit 60 using a battery activation switch 34A. The battery activation switch 34A may be located on the security system panel 25 or the external security system panel 25B.

In certain embodiments, the control unit 11 may incorporate a solar panel which provides power to recharge the battery 64. The solar panel may, for example, be positioned on the housing lid 14, or may further be provided as a separate component which can be attached to the control unit via a power cable.

In a preferred embodiment, the control circuit 60 may further comprise a sensor signal input 88 and a sensor power output circuit 86. The sensing unit of each modular sensor 39 requires electrical power to operate, and the sensor power output circuit 86 delivers the necessary electrical power from the power supply 62 to each modular sensor 39. The sensor power output circuit 86 may further incorporate one or more sensor switches, which allow any of the modular sensors 39 to be disabled or enabled by controlling the electrical power flowing to the modular sensor 39. For example, the motion sensor 44 may be enabled or disabled via a motion sensor switch 44B. The sensor signal input circuit 88 operably connects the one or more modular sensors 39 with the one or more alert switches, allowing the alert switches to receive the alert signals transmitted by the modular sensors 39. In a preferred embodiment, both the sensor signal input circuit 88 and the power output circuit 86 are connected to the one or more modular sensors 39 through the interface of the pins 31 and pin receptacles 38 of the sensor connection ports 30 and sensor plugs 37. Each pin 31 and its corresponding pin receptacle 38 may be configured to carry the alert signal, electrical power, or a combination of both, as appropriate for the specific modular sensor 39 as will be apparent to a person of ordinary skill in the art in the field of the invention.

In a preferred embodiment, the control circuit 60 may be configured with at least one alert switch operably connected to the modular sensors 39 via the sensor signal input circuit 88, and an alert signal timer 80 operably connected to the at least one alert switch via an alert signal timer input 80A. When each alert switch receives an alert signal from the modular sensor 39 indicating the presence of an alert condition, the alert switch engages and sends a timer start signal to the alert signal timer 80. The alert switch may be implemented using a mechanical or solid-state relay, transistor, MOSFET, or other device. The alert signal timer 80 will then send an alarm trigger signal to the auto-dialer 68 via one or more auto-dialer inputs 69. Each auto-dialer input 69 may in turn represent an input channel, allowing the auto-dialer 68 to distinguish between alarm trigger signals sent by different sources, as well as other types of signals. For example, in a certain embodiment, the one or more auto-dialer inputs 69 may comprise a first, second, and third input channel 69A, 69B, 69C, with the alert signal timer 80 connected to the first input channel 69A. The auto-dialer inputs 69 may include additional input channels as needed. The auto-dialer 68 will then proceed to transmit the alarm call to the alarm recipient. The auto-dialer 68 can be implemented using various types of alarm dialers, alarm callout systems, or other similar devices which will be known to a person of ordinary skill in the art in the field of the invention. The auto-dialer 68 can be configured to transmit alarm calls via phone line, mobile phone and data network, Internet, or other telecommunication networks. The auto-dialer 68 may also communicate with an auto-dialer control server remotely via the WAN, allowing the auto-dialer 68 to be configured by the user remotely via the auto-dialer control server. The auto-dialer control server may also be configured to receive an alarm call or other call from the auto-dialer, so that the auto-dialer control server may retransmit the alarm call or other call to the alarm recipient.

If the alert condition persists, the modular sensor 39 may continuously send the alert signal to the alert switch. For example, if the smoke detector 40 continually detects smoke, the smoke detector will continuously send the alert signal to the alert switch. The alert switch will remain engaged and continue to send the timer start signal to the alert signal timer 80. The alert signal timer 80 is configured to repeat the alarm trigger signal to the auto-dialer 68 while the alert signal timer 80 continues to receive the timer start signal. Each time the alarm trigger signal repeats, the auto-dialer 68 may be configured to re-transmit the alarm call to the alarm recipient. In some embodiments, the alert signal timer 80 can be implemented using a two-stage timer with an integrated clock, which repeats the alarm trigger signal after a timer interval which may be expressed in units of time such as seconds, minutes, or hours.

In some embodiments, the user may suspend the transmission of alarm calls. Once the user becomes aware of the presence of an alert condition, it may be unnecessary for the user to receive further alarm calls. The alert signal timer 80 may incorporate an alarm stop input 80B which can be connected to the auto-dialer 68. The user may, upon receiving the alarm call, instruct the auto-dialer 68 to send an alarm stop signal to the alert signal timer 80 via the alarm stop input 80B, which can prevent the alert signal timer 80 from sending further alarm trigger signals to the auto-dialer 68. The alarm stop signal can be implemented as a command sent by the user either directly to the auto-dialer 68, or to the auto-dialer 68 via the auto-dialer control server. In place of interrupting the sending of alarm trigger signals, the user may instruct the auto-dialer 68 via the auto-dialer control server, to suspend the transmission of further alarm calls.

Each alert switch may be configured to operate with one particular type of modular sensor 39. For example, in a preferred embodiment, the at least one alert switch may include a fire alert switch 70 connected to the smoke detector 40, a motion alert switch 72 connected to the motion sensor 44, a freeze alert switch 74 connected to the thermostat 42, and a water flow alert switch 76 connected to the flow sensor 46. Each alert switch may be connected to one modular sensor 39, or in some embodiments, to more than one modular sensor 39 of the same type. For example, the motion alert switch 72 may be connected to more than one motion sensor 44. In certain embodiments, the control circuit 60 may include additional alert signal timers 80, where each alert switch may be connected to a different alert signal timer 80. For example, each of the fire, motion, freeze, and water flow alert switches 70, 72, 74, 76 may be paired with a fire, motion, freeze, and water flow alert signal timer respectively. Each of the fire, motion, freeze, and water flow alert signal timers may be connected to a different input channel, thereby allowing the auto-dialer 68 to distinguish between different types of alert conditions such as fire, freezing temperature, motion, and water flow alert conditions. Furthermore, different input channels may be used to distinguish between alert signals sent by different modular sensors 39 of the same type. For example, the portable security system 10 may employ four motion sensors 44, with each motion sensor 44 connected to a separate motion alert signal timer, with each motion alert signal timer connected to a different input channel. Further variations and combinations are possible, as will be appreciated by a person of ordinary skill in the art in the field of the invention.

The control circuit 60 may also have a status update circuit 66 which is configured to send a status update signal to the auto-dialer 68 via the auto-dialer inputs 69. The status update circuit 66 may include an integrated clock, and is configured to send the status update signal every time a status update interval elapses. The status update interval may correspond to any unit of time. For example, the status update interval may be set to a period of 24 hours, resulting in a daily status update. In order to distinguish the status update signal from an alarm trigger signal, the status update circuit may be connected to the second input channel 69B. Upon receiving the status update signal, the auto-dialer may transmit a status update call to the alarm recipient which indicates to the alarm recipient that the portable security system 10 is functioning properly. The status update circuit may be disabled or enabled via a status update switch 34B located on the security system panel 25 or external security system panel 25B.

The control circuit 60 may further incorporate a power loss detection circuit 78 configured to detect the loss of electrical power from the power source 61 to the power supply 62. Upon detecting the loss of electrical power, the power loss detection circuit 78 may send an alert signal to the alert signal timer 80. Alternatively, the power loss detection circuit 78 may instead be connected to the auto-dialer 68 via the auto-dialer inputs 69, and may send a power loss signal to the auto-dialer 68 via the third input channel 69C, allowing the auto-dialer to distinguish the power loss signal from an alarm trigger signal or a status update signal. Upon receiving the power loss signal, the auto-dialer 68 may then transmit a power loss call to the alarm recipient.

The control circuit 60 may further have an Ethernet switch 90 which allows the various components of the portable security system 10, such as the auto-dialer 68 or the IP camera 85, to share access to the WAN 92 via the network interface port 82. In certain embodiments, the Ethernet switch 90 may also serve as a mobile internet hotspot to allow the portable security system 10 to access the WAN 92 when the monitoring location does not provide access to the internet, or if the internet connection fails due to a power outage.

The control circuit 60 may also be configured to automatically activate the IP camera 85 when an alert condition is detected, such as by powering up the IP camera via power over Ethernet, by providing power to it via a power cable, or instructing the IP camera to activate via the IP camera server.

The control circuit 60 may also control the one or more alert indicator lights 32. In the preferred embodiment, each alert indicator light 32 may be connected to one of the alert switches, and illuminates upon the alert switch receiving the alert signal from the modular sensors 39. For example, the fire alert switch 70, the motion alert switch 72, and the freeze alert switch 74 may be connected to a fire alert indicator light 32A, a motion alert indicator light 32B, and a freeze alert indicator light 32C respectively.

The present disclosure contemplates multiple implementations of the control circuit 60, using discrete electromechanical components, solid-state components, or a combination of both, as can be appreciated by a person of ordinary skill in the art in the field of the invention. The control circuit 60 may be implemented using discrete alert signal timers 80 and alert switches, allowing the control circuit 60 to be customized to the needs of each user. The components of the control circuit 60 may be mounted within the housing compartment on the housing bottom panel 22. For example, if the user wishes to configure the portable security system with four motion sensors 44, the user can be provided with a customized control unit 11 configured to monitor each of the four motion sensors, and equipped with four sensor connection ports 30 adapted to interface with the motion sensors 44. The use of discrete components also allows the system to be rugged and easily repairable. Alternatively, the various functions of the control circuit 60 may be achieved using a solid-state implementation, such as through the use of a microprocessor to control the modular sensors 39 and the auto-dialer 68, allowing the control unit 11 to be provided in a compact size.

Figure 3:
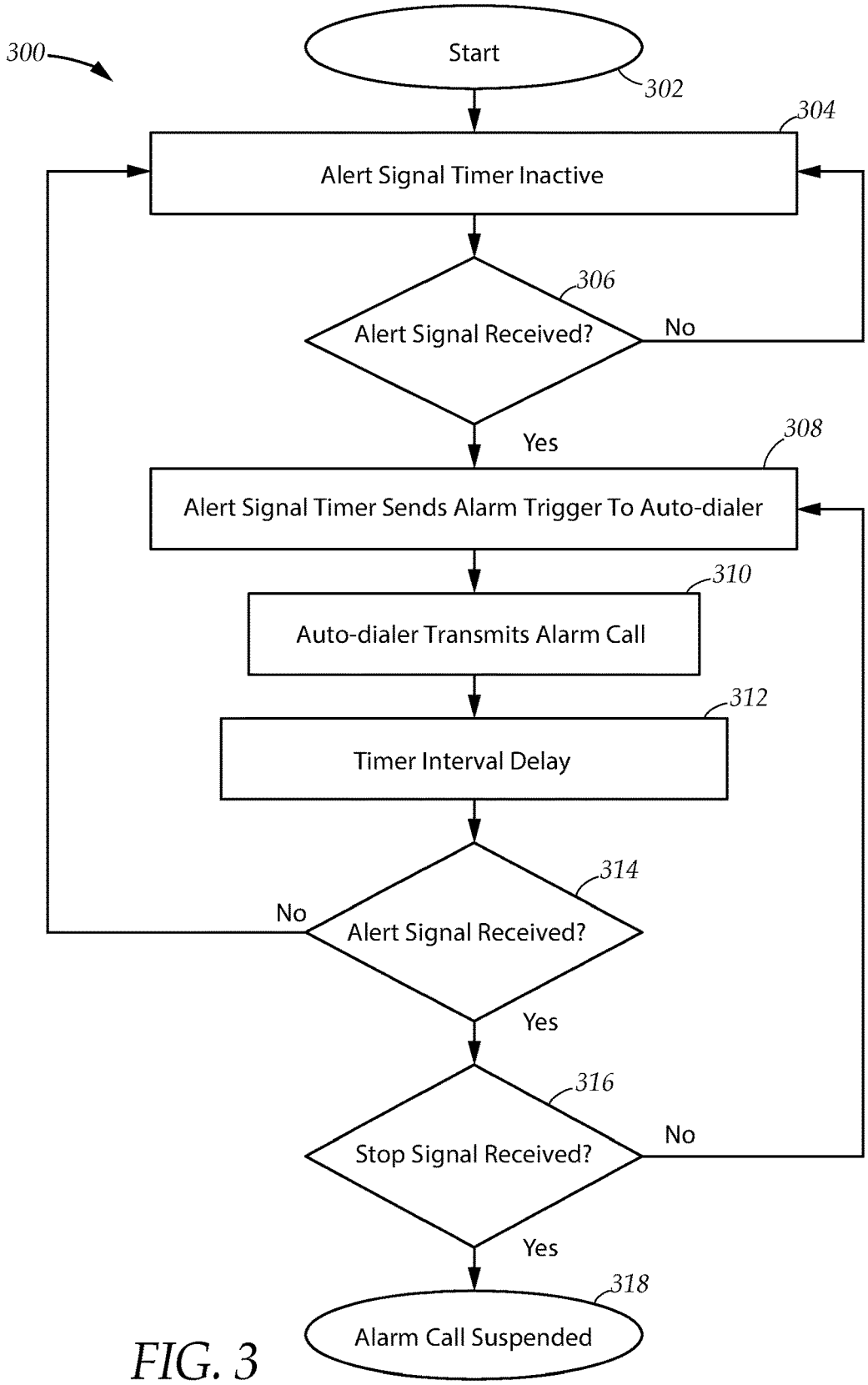
FIG. 3 is a flowchart depicting an exemplary alarm signaling process of the portable security system.

Turning now to FIG. 3, while simultaneously referring to FIGS. 1A and 2, an exemplary alarm signaling process 300 implemented on the portable security system 10 is depicted in flowchart form. The alarm signaling process 300 begins at step 302, when the portable security system is deployed and several of the modular sensors 39 are positioned within the monitoring location. Once positioned, the modular sensors 39 continually monitor for the presence of an alert condition at the monitoring location. The alert switches and alert signal timer 80 remain in an inactive state as long as no alert condition is detected, and step 304 represents this inactive state. Next, the alarm signaling process proceeds to step 306—if no alert condition is detected by the modular sensors 39, the process returns to step 304. However, if any modular sensor 39 detects the presence of an alert condition, that modular sensor 39 sends an alert signal to the alert switch connected to the modular sensor, and the alert switch in turn sends a timer start signal to the alert signal timer 80, causing the process to proceed to step 308. At step 308, the alert signal timer 80, upon receiving the timer start signal, sends an alarm trigger signal to the auto dialer 68 via the auto-dialer inputs 69, and the process proceeds to step 310.

At step 310, the auto-dialer 68 transmits an alarm call to the alarm recipient. The alarm call can be transmitted directly to the alarm recipient by the auto-dialer 68. Alternatively, the alarm call may first be transmitted to the auto-dialer control server, and the auto-dialer control server may then transmit the alarm call to the alarm recipient. Once the alarm call has been transmitted, the process proceeds to step 312. At step 312, the alarm signal timer 80 ceases sending the alarm trigger signal to the auto-dialer 68, and begins counting down the timer interval. In some embodiments, the timer interval may be set to two minutes. Once the timer interval has elapsed, the process proceeds to step 314. If the modular sensor 39 continues to detect the alert condition, the modular sensor will continuously send the alert signal to the alert switch, and the alert switch will continue to send the timer start signal to the alert signal timer 80. At step 314, if the alert condition is no longer detected by the modular sensor 39, the alert switch and alert signal timer 80 will revert to the inactive state and the process returns to step 304. If the alert condition persists, the process proceeds to step 316. At step 316, the alert signal timer 80 is configured to resend the alarm trigger signal to the auto-dialer 68 unless the user instructs the portable security system to suspend further alarm calls by sending the alarm stop signal to the auto-dialer 68 or the auto-dialer control server. If no alarm stop signal is received by the portable security system, the process returns to step 308. The alert signal timer 80 resends the alarm trigger signal to the auto-dialer 68, and the auto-dialer 68 will retransmit the alarm call to the alarm recipient. However, if the user sends the alarm stop signal to the portable security system 10, the process instead proceeds to step 318, and the alarm call is suspended. Note that this process is non-limiting, and the individual steps may be varied in accordance with the principles of the present disclosure, as can be appreciated by a person of ordinary skill in the art in the field of the invention.

Figure 4:
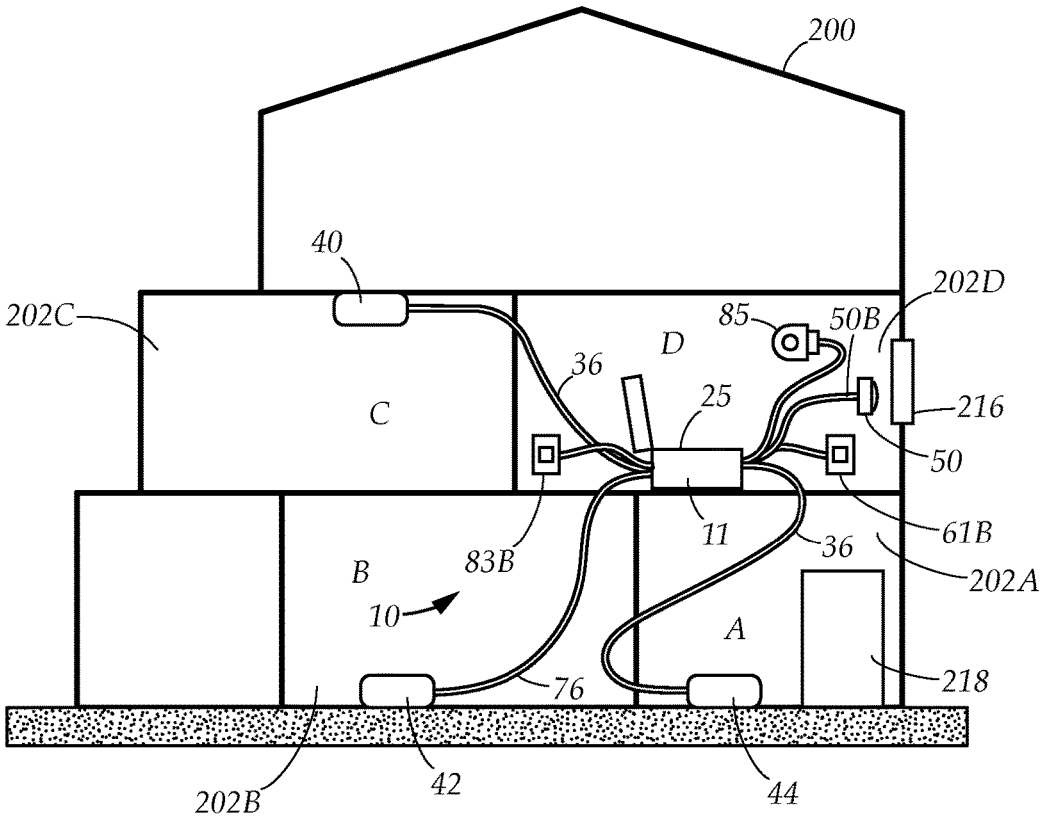
FIG. 4 is a diagrammatical orthographic view of a house in which an embodiment of a portable security system is deployed, in accordance with the present disclosure.

Turning to FIG. 4, while also referring to FIG. 1A, an exemplary portable security system 10 is shown deployed within a monitoring location representing a multi-level house 200 with a plurality of rooms, including rooms A, B, C, and D 202A, 202B, 202C, 202D. The user deploys the portable security system 10 by placing the control unit 11 within room D 202D and connecting the control unit 11 to a power outlet 61B. The user may also connect the network interface port 82 of the control unit 11 to a network port 83B, allowing the portable security system 10 to access the monitoring location's internet connection. The portable security system 10 is depicted with three modular sensors—the smoke detector 40, thermostat 42, and motion sensor 44, which are positioned in rooms C, B, and A respectively 202C, 202B, 202A. Each modular sensor is linked to the control unit 11 via its respective sensor cable 36. In the present example, the motion sensor 44 is further positioned to detect motion in the direction of a door 218 which may indicate entry into the house. In the present example, the IP camera is positioned within room D 202D to observe the control unit 11 itself. In embodiments where the portable security system does not provide alert condition details within the alarm call, the IP camera may be positioned to face the security system panel 25, allowing the user to remotely view the alert indicator lights 32 in order to see which modular sensors have detected alert conditions. The IP camera 85 may alternatively be placed anywhere within the monitoring location. Room D 202D has a window 216, and the strobe light 50 may be positioned within the window 216 and connected to the control unit 11 via the strobe cable 50B. This allows the flashing strobe light 50 to be visible from the exterior of the house.

Figure 5:
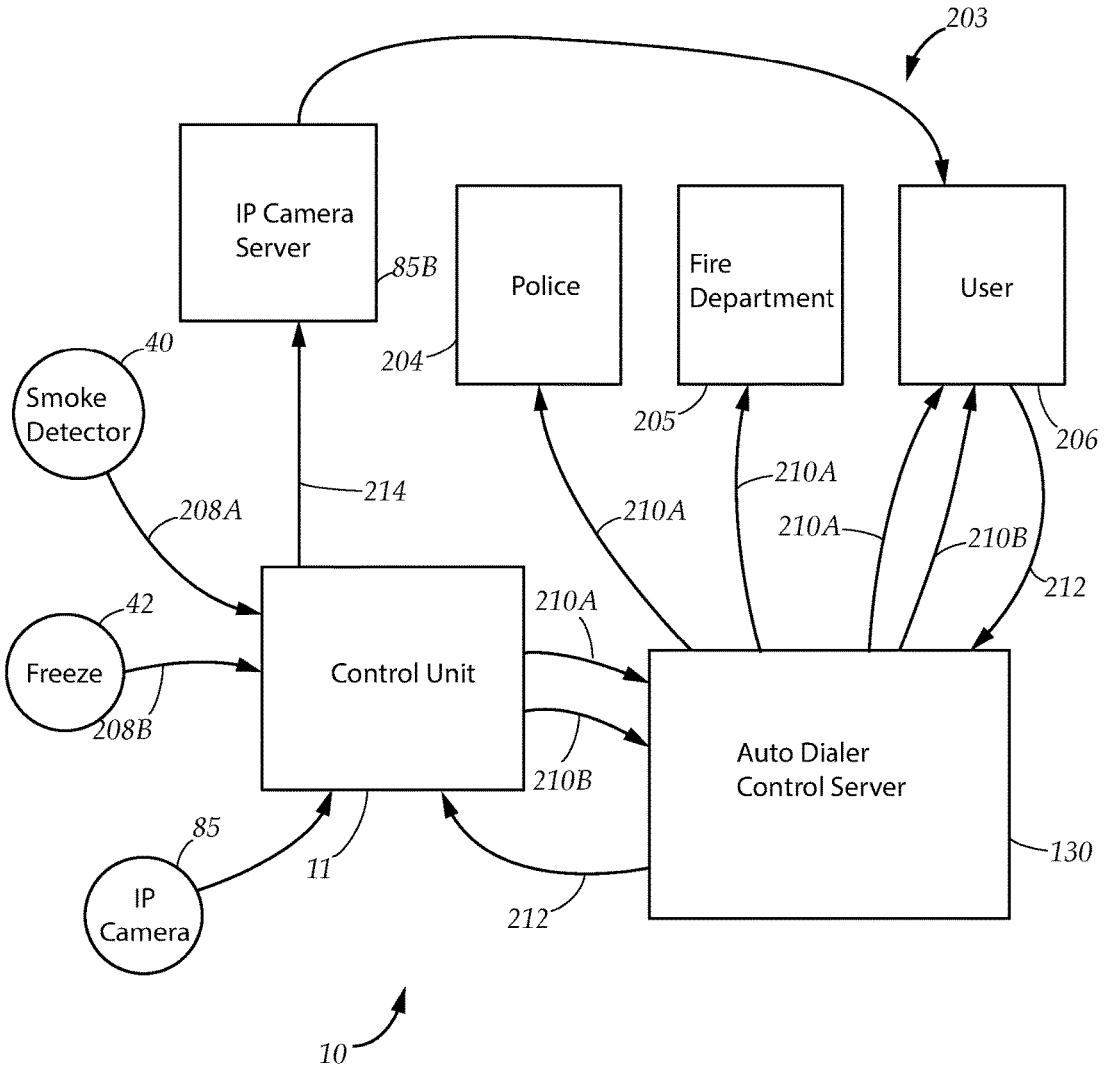
FIG. 5 is a block diagram depicting an exemplary alarm call transmitted by the portable security system to an alarm recipient.

Turning now to FIG. 5, while simultaneously referring to FIGS. 1A and 2, a block diagram depicting an exemplary alarm call transmitted to the alarm recipients 203 is shown. In the present example, the auto-dialer 68 is programmed to transmit alarm calls to three alarm recipients 203, including the police 204, the fire department 205, and the user 206. Two modular sensors 39 are connected to the control unit 11—the smoke detector 40 and the thermostat 42, and the auto-dialer 68 is further configured to transmit alarm calls indicating the type of alert condition detected.

Continuing with the present example, the smoke detector 40 detects smoke within the monitoring location and sends a fire alert signal 208A to the control unit 11. The auto-dialer 68 is configured to transmit an alarm call 210A to the auto-dialer control server 130, indicating that a fire alert condition is detected. The auto-dialer control server 130 then transmits an alarm call 210A to each of the police 204, fire department 205, and the user 206, alerting each alarm recipient of the fire alert condition.

In another example, the thermostat 42 detects a large drop in temperature and sends a freezing temperature alert signal 208B to the control unit 11. The auto-dialer 68 then transmits an alarm call 210B to the auto-dialer control server 130 indicating that a freezing temperature alert condition is detected. As the presence of freezing temperature generally does not count as an emergency, the auto-dialer 68 may be configured to notify only the user. In the present example, the auto-dialer control server 130 transmits an alarm call 210B only to the user 206, alerting the user of the freezing temperature alert condition. Furthermore, the user 206 responds to the alarm call 210B by sending an alarm stop signal 212 to the auto-dialer 68 via the auto-dialer control server 130, suspending further alarm calls for freezing temperature alert conditions.

The IP camera 85 may be configured to activate once the portable security system 10 detects either the fire or freezing temperature alert conditions. The IP camera then transmits the IP camera feed 214 to the IP camera server 85B. The user may then access the IP camera server 85B and view the video feed from the IP camera.

As will be appreciated by one skilled in the art, aspects of the present disclosure may be embodied as a system, method or computer program product. Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium (including, but not limited to, non-transitory computer readable storage media). A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate or transport a program for use by or in connection with an instruction execution system, apparatus or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. Other types of languages include XML, XBRL and HTML5. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described below with reference to flowchart illustrations and/or block diagrams of methods, apparatus (systems) and computer program products according to embodiments of the disclosure. Each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality and operation of possible implementations of systems, methods and computer program products according to various embodiments of the present disclosure. In this regard, each block in the flowchart or block diagrams may represent a module, segment or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

The flow diagrams depicted herein are just one example. There may be many variations to this diagram or the steps (or operations) described therein without departing from the spirit of the disclosure. For instance, the steps may be performed in a differing order and/or steps may be added, deleted and/or modified. All of these variations are considered a part of the claimed disclosure.

In conclusion, herein is presented a portable security system. The disclosure is illustrated by example in the drawing figures, and throughout the written description. It should be understood that numerous variations are possible, while adhering to the inventive concept. Such variations are contemplated as being a part of the present disclosure.

What is claimed is:

1. A portable security system which is deployed by a user within a monitoring location comprising a building, structure, or space, comprising:

one or more modular sensors, each modular sensor adapted to detect an alert condition within the monitoring location, the alert condition comprising a fire alert condition, a freezing temperature alert condition, or a motion alert condition, each modular sensor comprising a sensing unit operably connected to a sensor cable, the sensor cable further having a sensor plug;

a control unit having a security system panel, and one or more sensor connection ports, each sensor connection port is positioned on the security system panel and is adapted to receive the sensor plug of each modular sensor, the control unit further comprising a portable housing having a plurality of housing panels, with each housing panel having a panel inner surface and a panel outer surface, the portable housing further comprising a housing compartment defined by the inner surface of each housing panel within the plurality of housing panels;

a control circuit contained within the housing compartment and which is operably connected to the one or more sensor connection ports, the control unit comprising one or more alert switches, an alert signal timer, and an auto-dialer, the auto-dialer is operably connected to a communications network and is further adapted to transmit an alarm call to an alarm recipient via the communications network;

wherein the housing of the control unit is adapted to be portable to allow the user to carry the control unit to the monitoring location;

wherein the one or more modular sensors are adapted to be positioned by the user at any point within the monitoring location within a range defined by the length of the sensor cable of each modular sensor;

wherein the sensor plug of each modular sensor forms a detachable connection with the one or more sensor connection ports and is operably connected to the one or more alert switches;

wherein each modular sensor transmits an alert signal to the one or more alert switches upon detecting the alert condition;

wherein the one or more alert switches transmits a timer start signal to the alert signal timer upon receiving the alert signal;

wherein the alert signal timer transmits an alarm trigger signal to the auto-dialer upon receiving the timer start signal;

wherein the auto-dialer transmits the alarm call to the alarm recipient upon receiving the alarm trigger signal; and wherein the alarm call comprises a voice, text, or data message indicating to the alarm recipient the presence of the alert condition within the monitoring location.

2. The portable security system described in claim 1, wherein the alert signal timer measures a time interval, and retransmits the alarm trigger signal to the auto-dialer after the elapsing of the timer interval, as long as the one or more modular sensors continue to detect the alert condition.

3. The portable security system as described in claim 2, wherein the control circuit unit measures a repeating status update interval, and the auto-dialer transmits a status update call to the user when the status update interval elapses, indicating to the user that the portable security system is functioning.

4. The portable security system as described in claim 3, wherein the control circuit further comprises a power supply and a rechargeable battery, the power supply is adapted to provide power to the portable security system from a power source within the monitoring location, and wherein the rechargeable battery provides power to the portable security system in the absence of power from the power source to the power supply.

5. The portable security system as described in claim 4, wherein the one or more modular sensors comprises a smoke detector adapted to detect the fire alert condition, a thermostat adapted to detect the freezing temperature alert condition, a motion sensor adapted to detect the motion alert condition, or a flow sensor adapted to detect a water flow alert condition.

6. The portable security system as described in claim 5, wherein the one or more sensor connection ports further comprise one or more pins, and each sensor plug comprises one or more pin receptacles, wherein the one or more sensor connection ports comprise a first sensor connection port and a second sensor connection port, and the one or more pins of the first sensor connection port and the second sensor connection port are arranged in a first pin configuration and second pin configuration respectively, wherein each sensor plug corresponds to a first sensor plug or a second sensor plug, and the one or more pin receptacles of the first sensor plug and the second sensor plug are arranged in a first pin receptacle configuration and a second pin receptacle configuration respectively, and wherein the first sensor connection port exclusively receives the first sensor plug, and the second sensor connection port exclusively receives the second sensor plug.

7. The portable security system of claim 6, wherein the security system panel further comprises one or more alert indicator lights, wherein each alert indicator light corresponds to the fire alert condition, motion alert condition, freezing temperature alert condition, or the water flow alert condition, and wherein each alert indicator light illuminates when the portable security system detects the alert condition corresponding to the alert indicator light.

8. The portable security system of claim 7, further comprising an IP camera detachably connected to the control unit, wherein the IP camera is activated when the portable security system detects the alert condition, wherein the IP camera transmits an IP camera feed via the communications network to an IP camera server, and wherein the user views the IP camera feed by accessing the IP camera server.

9. The portable security system of claim 8, wherein the IP camera is positioned to capture the security system panel within the IP camera feed, allowing the user to view the one or more alert indicator lights.

10. The portable security system of claim 9, further comprising a strobe light, wherein the strobe light is operatively connected to the control unit via a strobe cable, wherein the strobe light is adapted to flash when the portable security system detects the alert condition.

11. The portable security system of claim 10, wherein the plurality of housing panels comprises a housing top panel, a housing bottom panel, a housing front panel, a housing rear panel, a housing bottom panel, and housing side panels, and the security system panel is positioned on the housing top panel.

12. The portable security system of claim 11, wherein the housing further comprises a housing lid, the housing lid having a plurality of lid panels which project from the housing lid to define a lid compartment, wherein the housing lid is attached to the housing rear panel via a hinge, allowing the housing lid to hingedly open and close along the hinge between an open position and a closed position, and wherein the lid compartment covers the housing top panel when the housing lid is in the closed position.

13. The portable security system of claim 12, wherein the lid compartment contains one or more cable storage mounts attached to the housing lid, wherein each cable storage mount is adapted to retain one of the modular sensors by coiling the sensor cable of the modular sensor around the cable storage mount.

14. The portable security system of claim 13, wherein the housing top panel is recessed, forming an upper compartment defined by the housing top panel, the housing side panels, the housing front panel, and the housing rear panel, wherein the upper compartment combines with the lid compartment to store the one or more modular sensors, the IP camera, and the strobe light.

15. The portable security system of claim 14, wherein the housing further comprises a handle, allowing the user to carry the control unit by grasping the handle.

16. The portable security system of claim 15, wherein the security system panel is disposed on the housing front panel or the housing side panels, allowing the portable security system to function with the housing lid in the closed position.

* * * * *